US010821407B2

(12) United States Patent
Desrochers et al.

(10) Patent No.: US 10,821,407 B2
(45) Date of Patent: Nov. 3, 2020

(54) AUGER EXTENSION FOR A VERTICAL MIXER, EXTENDABLE AUGER FOR A VERTICAL MIXER AND VERTICAL MIXER INCLUDING THE SAME

(71) Applicant: Groupe Anderson Inc., Chesterville, Quebec (CA)

(72) Inventors: Patrice Desrochers, Chesterville (CA); Jordan Vachon, Chesterville (CA); Jacques Breton, Chesterville (CA); Michaël Gagnon-Bouchard, Chesterville (CA)

(73) Assignee: Groupe Anderson Inc., Chesterville (CA)

( * ) Notice: Subject to any disclaimer, the term of this patent is extended or adjusted under 35 U.S.C. 154(b) by 302 days.

(21) Appl. No.: 16/049,189

(22) Filed: Jul. 30, 2018

(65) Prior Publication Data

US 2020/0030758 A1 Jan. 30, 2020

(51) Int. Cl.

| | |
|---|---|
| ***B01F 7/00*** | (2006.01) |
| ***B01F 7/24*** | (2006.01) |
| ***B01F 7/16*** | (2006.01) |

(52) U.S. Cl.

CPC ..... *B01F 7/00716* (2013.01); *B01F 7/00616* (2013.01); *B01F 7/00633* (2013.01); *B01F 7/162* (2013.01); *B01F 7/241* (2013.01); *B01F 2215/0024* (2013.01)

(58) Field of Classification Search

CPC ..... B01F 7/00716; B01F 7/00616; B01F 7/00633; B01F 7/162; B01F 7/241; B01F 2215/0024; A01K 5/004

See application file for complete search history.

(56) References Cited

U.S. PATENT DOCUMENTS

| | | | | |
|---|---|---|---|---|
| 2003/0169639 | A1* | 9/2003 | Plas | B01F 15/00824 366/297 |
| 2012/0008457 | A1* | 1/2012 | Neier | B01F 15/00545 366/190 |
| 2015/0226314 | A1* | 8/2015 | Liet | F16H 57/0486 366/145 |

* cited by examiner

*Primary Examiner* — Anshu Bhatia

(74) *Attorney, Agent, or Firm* — Andrus Intellectual Property Law, LLP

(57) ABSTRACT

An extendable auger having a base section, an extension section, an extension fixation assembly and a cover. The base section includes a base section central shaft having a hollow core and a base section helical member. The extension section is positionable over the base section and includes an extension section central shaft having a hollow core and an extension section helical member. The extension fixation assembly includes a base support wall positioned at the top end of the base section central shaft and an extension abutment wall positioned at the bottom end of the extension section central shaft. The base support wall is superposable to the extension abutment wall and securable thereagainst. The extension fixation assembly further includes a fastening assembly configured to removably secure the extension section to the base section, when the base support wall and the extension abutment wall are superposed to one another.

18 Claims, 8 Drawing Sheets

AUGER EXTENSION FOR A VERTICAL MIXER, EXTENDABLE AUGER FOR A VERTICAL MIXER AND VERTICAL MIXER INCLUDING THE SAME

TECHNICAL FIELD OF THE INVENTION

The present invention relates to the field of vertical mixers. More particularly, it relates to an auger extension for a vertical mixer, to an extendable auger for a vertical mixer and to a vertical mixer including the same.

BACKGROUND

It is known in the art to use industrial vertical mixers, for example to prepare total mixed rations (TMR) for feeding livestocks. Such vertical mixers typically include a tub having an open top, a closed bottom and a peripheral wall and thereby defining a mixing chamber. The vertical mixers also typically include at least one auger substantially centered in the tub and extending substantially vertically in the mixing chamber, for rotation about a vertical axis. In several cases, the auger(s) is/are combined with serrated cutting blades for cutting long strands of forages, such as hay, into smaller lengths and therefore allows such materials to better mix with grains and other commodities, for example to prepare the desired TMR. The height of the auger(s) of a vertical mixer, is/are usually adapted to a height of the corresponding mixing chamber, for example, in order to perform the desired processing of the strands of forages and yield TMR with strands of forage of a desired size.

In some instances, it is desired to increase the capacity of the mixing chamber of a vertical mixer, for example in order to increase the volumetric capacity of each total mixed rations (TMR) which can be produced using the vertical mixer. To do so, one possibility is to install peripheral wall extensions, mounted at an upper edge of the peripheral wall of the tub, and extending upwardly therefrom, in order to produce a larger mixing chamber.

Such a solution yields the desired increased tub (and mixing chamber) capacity. However, vertical mixers including such peripheral wall extensions, mounted at an upper edge of the peripheral wall of the tub, tend to suffer from several drawbacks. Indeed, in such cases, the height of the augers(s) is no longer optimized for the height of the corresponding mixing chamber, given that the height of the mixing chamber is increased by the addition of an additional section of the tub, at the top thereof.

In view of the above, there is a need for an improved auger extension for a vertical mixer, an extendable auger for a vertical mixer and/or a vertical mixer including the same which, by virtue of its design and components, would be able to overcome or at least minimize some of the above-discussed prior art concerns.

SUMMARY OF THE INVENTION

In accordance with a first general aspect, there is provided an extendable auger for a vertical mixer. The extendable auger comprises a base section, an extension section removably securable to the base section, an extension fixation assembly and a cover. The base section includes a base section central shaft having a hollow core and a top end, and a base section helical member having a helical edge and being mounted to the base section central shaft to extend peripherally therefrom. The extension section is positionable over the base section and includes an extension section central shaft having a hollow core, a lower end and a top end with an extension support wall positioned at the top end thereof. The extension section further includes an extension section helical member having a helical edge and being mounted to the extension section central shaft to extend peripherally therefrom. The extension fixation assembly includes a base support wall positioned at the top end of the base section central shaft and an extension abutment wall positioned at the bottom end of the extension section central shaft. The base support wall is superposable to the extension abutment wall and securable thereagainst. The extension fixation assembly further includes a fastening assembly configured to removably secure the extension section to the base section, when the base support wall and the extension abutment wall are superposed to one another. The cover is superposable and removably securable to one of the base support wall and the extension support wall.

In an embodiment, the base support wall and the extension abutment wall are angled relative to a horizontal plane of between about 1 degree and about 60 degrees.

In an embodiment, the base section further comprises base section serrated cutting blades mounted to the base section helical member and extending past the helical edge thereof. The extension section further comprises extension section serrated cutting blades mounted to the extension section helical member and extending past the helical edge thereof.

In an embodiment, the fastening assembly includes fastening bores defined in the base support wall and the extension abutment wall. The fastening bores are aligned when the base support wall and the extension abutment wall are superposed to one another, to receive auger extension fasteners therein.

In an embodiment, each one of the base support wall and the extension abutment wall are annular walls including a hollow central section providing access to the hollow core of the corresponding one of the base section central shaft and the extension section central shaft.

In an embodiment, each one of the base support wall and the extension abutment wall include projections projecting inwardly towards the hollow central section thereof, with the fastening bores each being defined in a section of a corresponding one of the projections.

In an embodiment, the extension section increases a height of the extendable auger of between about 20% and about 50%, when mounted to the base section.

In accordance with another general aspect, there is also provided a vertical mixer. The vertical mixer comprises a tub including a tub wall having a top edge and an inner surface defining a mixing chamber having an open top and a closed bottom, The tub further includes a tub wall extension mountable to the tub wall, at a top edge thereof. The vertical mixer further comprises at least one extendable auger extending substantially vertically into the mixing chamber from the bottom thereof. Each one of the at least one extendable auger comprises a base section, an extension section removably securable to the base section, an extension fixation assembly and a cover. The base section includes a base section central shaft having a hollow core and a top end, and a base section helical member having a helical edge and being mounted to the base section central shaft to extend peripherally therefrom. The extension section is positionable over the base section and includes an extension section central shaft having a hollow core, a lower end and a top end with an extension support wall positioned at the top end thereof. The extension section further includes an extension section helical member having a helical edge and being mounted to the extension section central shaft to extend peripherally therefrom. The extension fixation assembly includes a base support wall positioned at the top end of the base section central shaft and an extension abutment wall positioned at the bottom end of the extension section central shaft. The base support wall is superposable to the extension abutment wall and securable thereagainst. The extension fixation assembly further includes a fastening assembly configured to removably secure the extension section to the base section, when the base support wall and the extension abutment wall are superposed to one another. The cover is superposable and removably securable to one of the base support wall and the extension support wall.

In an embodiment, the base section of the extendable auger further comprises base section serrated cutting blades mounted to the base section helical member and extending past the helical edge thereof. The extension section of the extendable auger further comprises extension section serrated cutting blades mounted to the extension section helical member and extending past the helical edge thereof.

In an embodiment, the fastening assembly includes fastening bores defined in the base support wall and the extension abutment wall, the fastening bores being aligned when the base support wall and the extension abutment wall are superposed to one another, to receive auger extension fasteners therein.

In an embodiment, each one of the base support wall and the extension abutment wall are annular walls including a hollow central section providing access to the hollow core of the corresponding one of the base section central shaft and the extension section central shaft.

In an embodiment, each one of the base support wall and the extension abutment wall include projections projecting inwardly towards the hollow central section thereof, with the fastening bores each being defined in a section of a corresponding one of the projections.

In an embodiment, the extension section increases a height of the extendable auger of between about 20% and about 50%, when mounted to the base section.

In accordance with another general aspect, there is further provided an auger extension for an auger of a vertical mixer including an extendable auger having a base section with a base support wall positioned at a top edge thereof. The auger extension comprises an extension section removably securable on top of the base section, an extension fixation assembly and a cover. The extension section includes an extension section central shaft having a hollow core, a lower end and a top end with an extension support wall positioned at the top end thereof. The extension section further includes an extension section helical member having a helical edge and being mounted to the extension section central shaft to extend peripherally therefrom. The extension fixation assembly includes an extension abutment wall positioned at the bottom end of the extension section central shaft, the extension abutment wall being superposable to the base support wall and securable thereagainst. The extension fixation assembly further includes a fastening assembly configured to removably secure the extension section to the base section, when the base support wall and the extension abutment wall are superposed to one another. The cover is superposable and removably securable to the extension support wall.

In an embodiment, the extension section further comprises extension section serrated cutting blades mounted to the extension section helical member and extending past the helical edge thereof.

In an embodiment, the extension abutment wall is angled relative to a horizontal plane of between about 1 degree and about 60 degrees.

In an embodiment, the fastening assembly includes fastening bores defined in the extension abutment wall, the fastening bores being aligned with corresponding bores defined in the base support wall when the base support wall and the extension abutment wall are superposed to one another, to receive auger extension fasteners therein.

In an embodiment, the extension abutment wall is an annular wall including a hollow central section providing access to the hollow core of the extension section central shaft.

In an embodiment, the extension abutment wall includes projections projecting inwardly towards the hollow central section thereof, with the fastening bores each being defined in a section of a corresponding one of the projections.

In an embodiment, the extension section increases a height of the extendable auger of between about 20% and about 50%, when mounted to the base section.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

Figure 1:
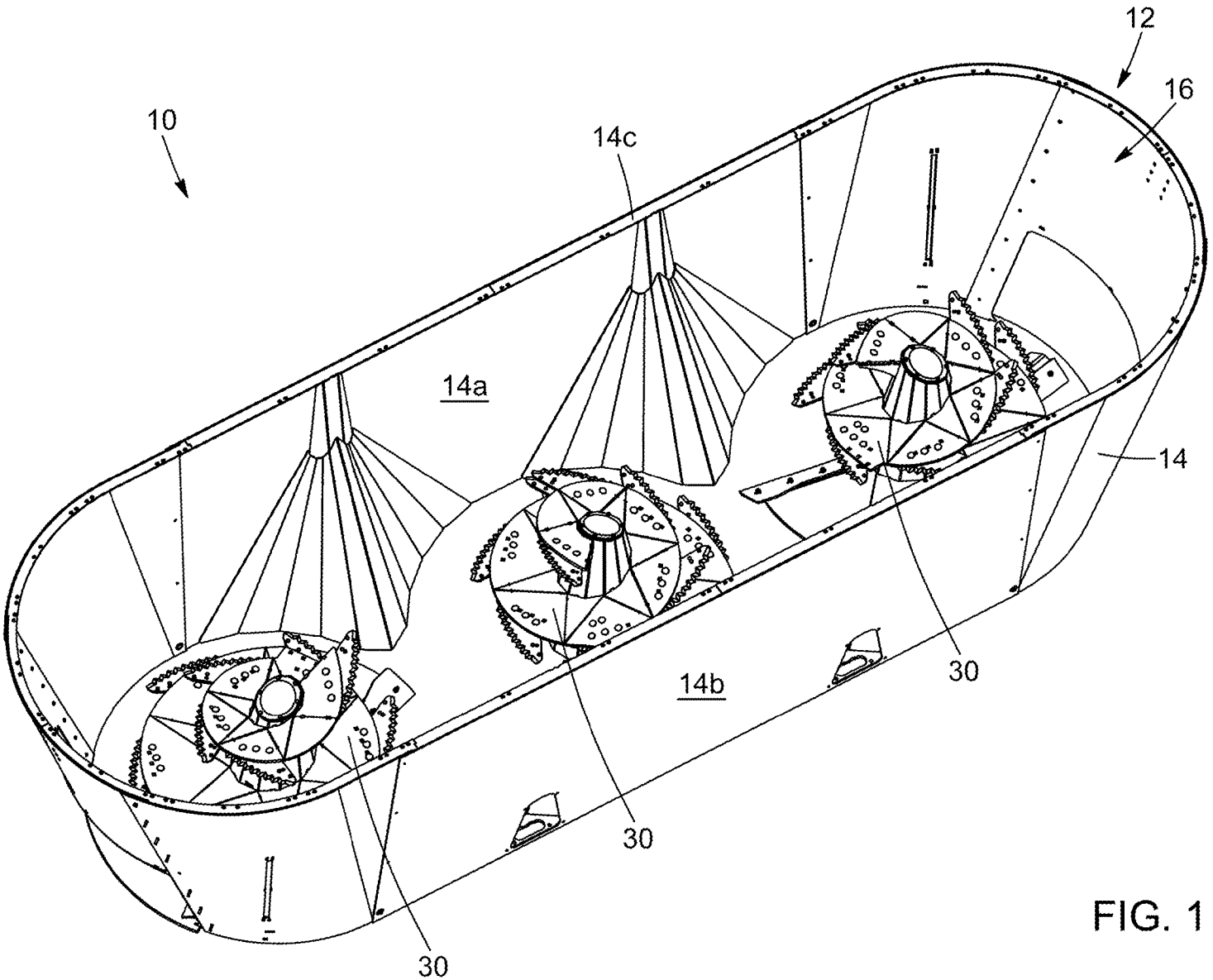
FIG. 1 is an isometric view of a vertical mixer, in accordance with an embodiment where no tub wall extension is mounted to the tub wall and the extendable auger is configured in a base configuration.

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the auger extension for a vertical mixer, the extendable auger for a vertical mixer and/or the mixer including the same and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the auger extension for a vertical mixer, the extendable auger for a vertical mixer and/or the vertical mixer including the same, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Referring generally to FIGS. 1 to 4, in accordance with one embodiment, there is provided a vertical mixer 10 which, for example and without being limitative, can be used for processing silage and/or mixing an animal feed composition used to feed livestock such as cattle or the like. In the embodiment shown, the vertical mixer 10 is a total mixed rations (TMR) mixer used to prepare total mixed rations for feeding livestock. One skilled in the art would however understand that, in alternative embodiments (not shown), the vertical mixer 10 could be adapted for different purposes, such as straw cutting or the like.

The vertical mixer 10 includes a tub 12 (or hopper) with a tub wall 14 having an inner surface 14*a* and an outer surface 14*b*. The inner surface 14*a* of the tub wall 14 defines a mixing chamber 16 having an open top and a closed bottom. In the embodiment shown, the mixing chamber 16 is configured to receive forages, grains, protein supplements, minerals, vitamins, or other feedstuffs to be mixed, for example in order to prepare the TMR. In the embodiment shown, the open top of the tub 12 can be used as an inlet 26 for the introduction of the forages, grains, protein supplements, minerals, vitamins, or other feedstuffs to be mixed in the tub 12.

Figure 2:
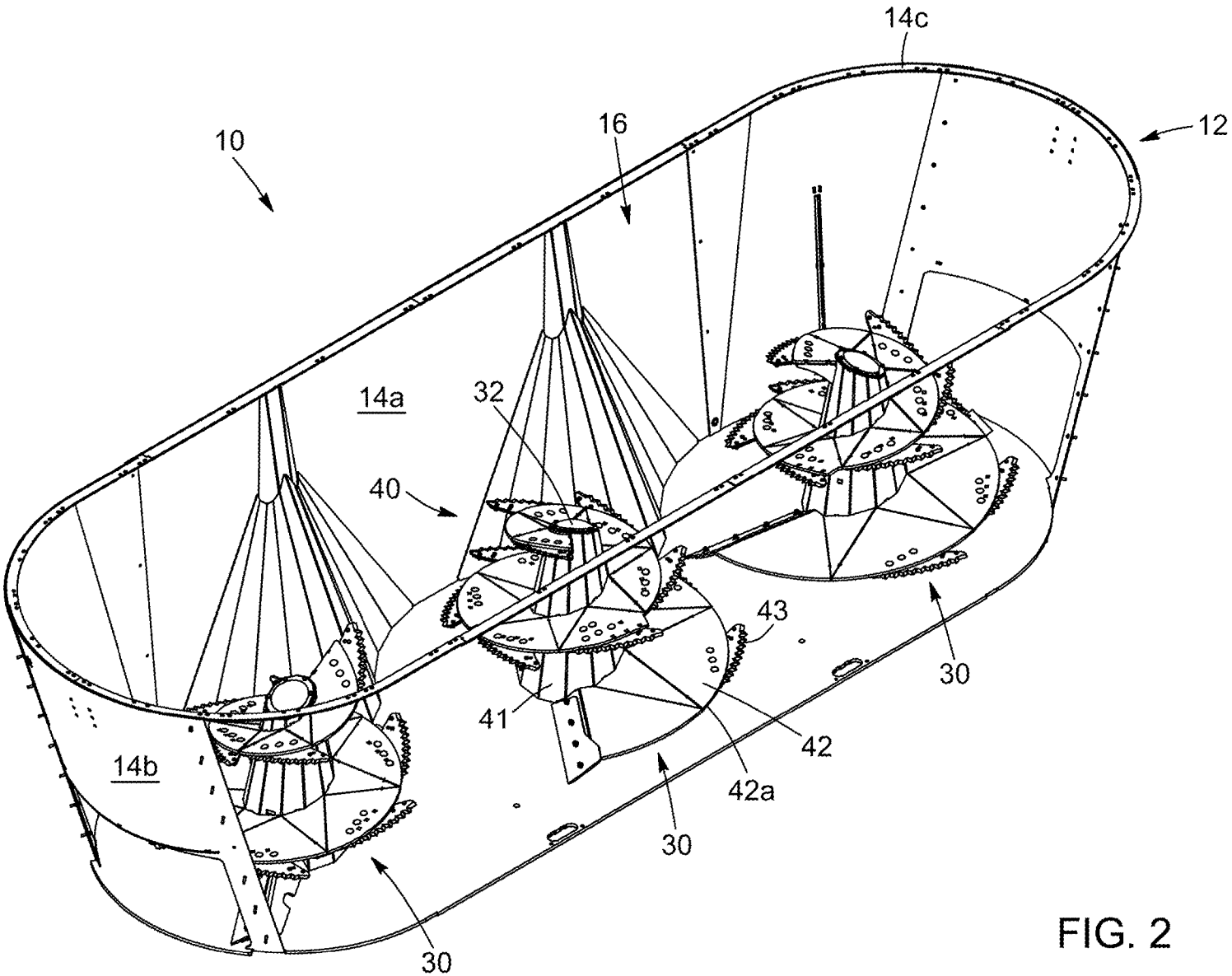
FIG. 2 is an isometric view of the vertical mixer of FIG. 1, shown with a section of a tub wall removed.
Figure 3:
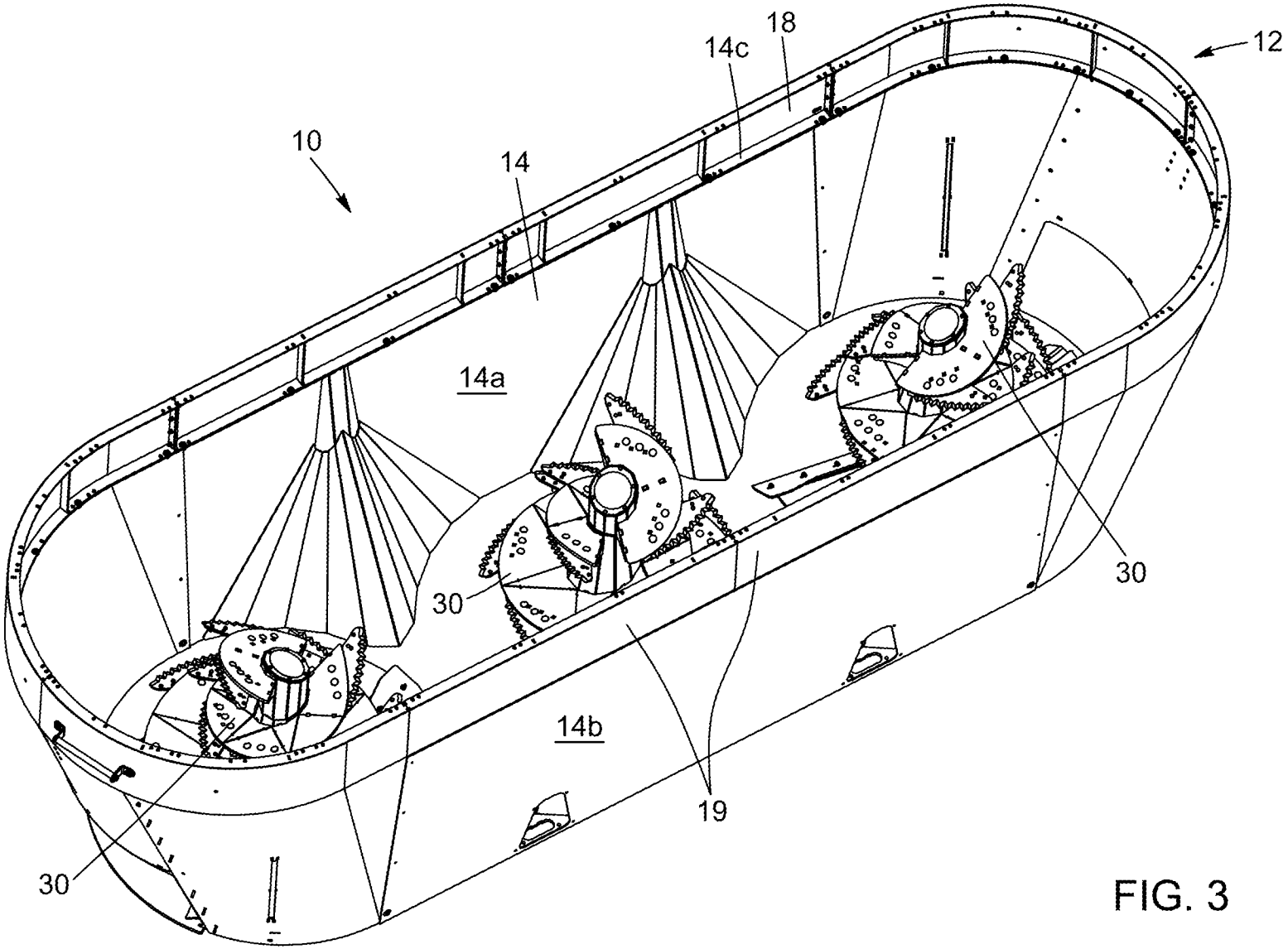
FIG. 3 is an isometric view of a vertical mixer, in accordance with an embodiment where a tub wall extension is mounted to the tub wall and the extendable auger is configured in an extended configuration.
Figure 4:
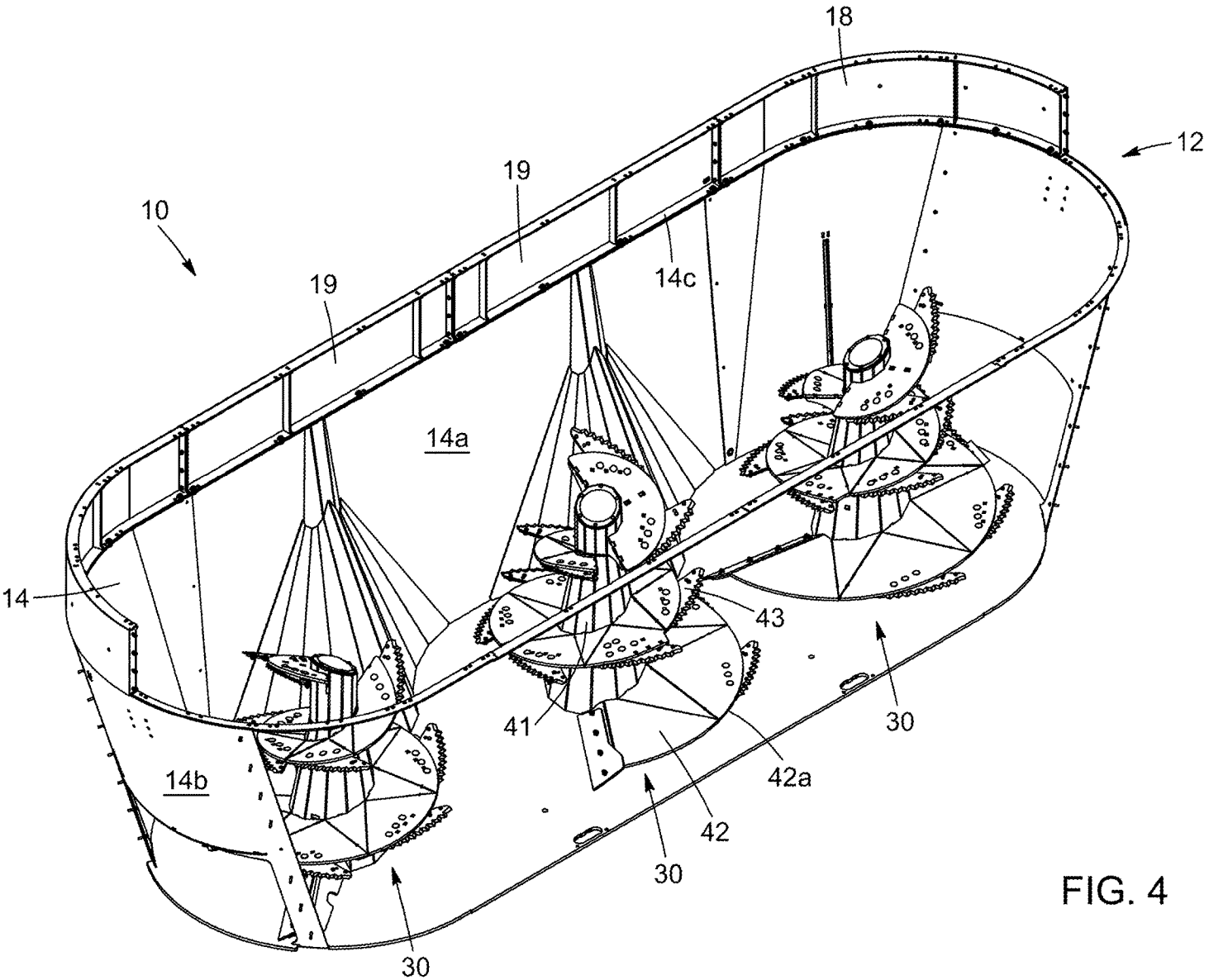
FIG. 4 is an isometric view of the vertical mixer of FIG. 3, shown with a section of a tub wall removed.
Figure 5:
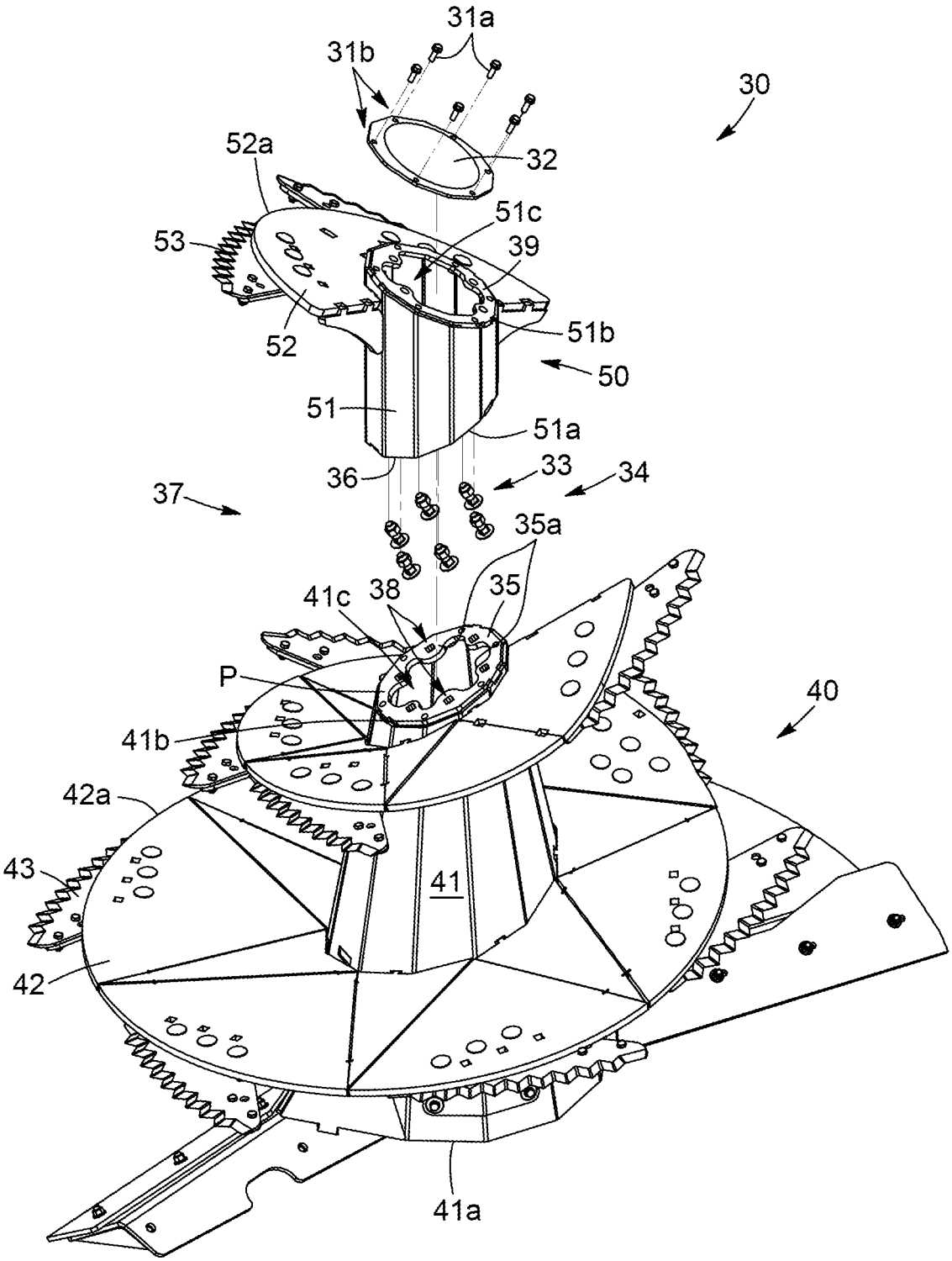
FIG. 5 is a front exploded view of an extendable auger of the vertical mixer of FIG. 4.
Figure 5A:
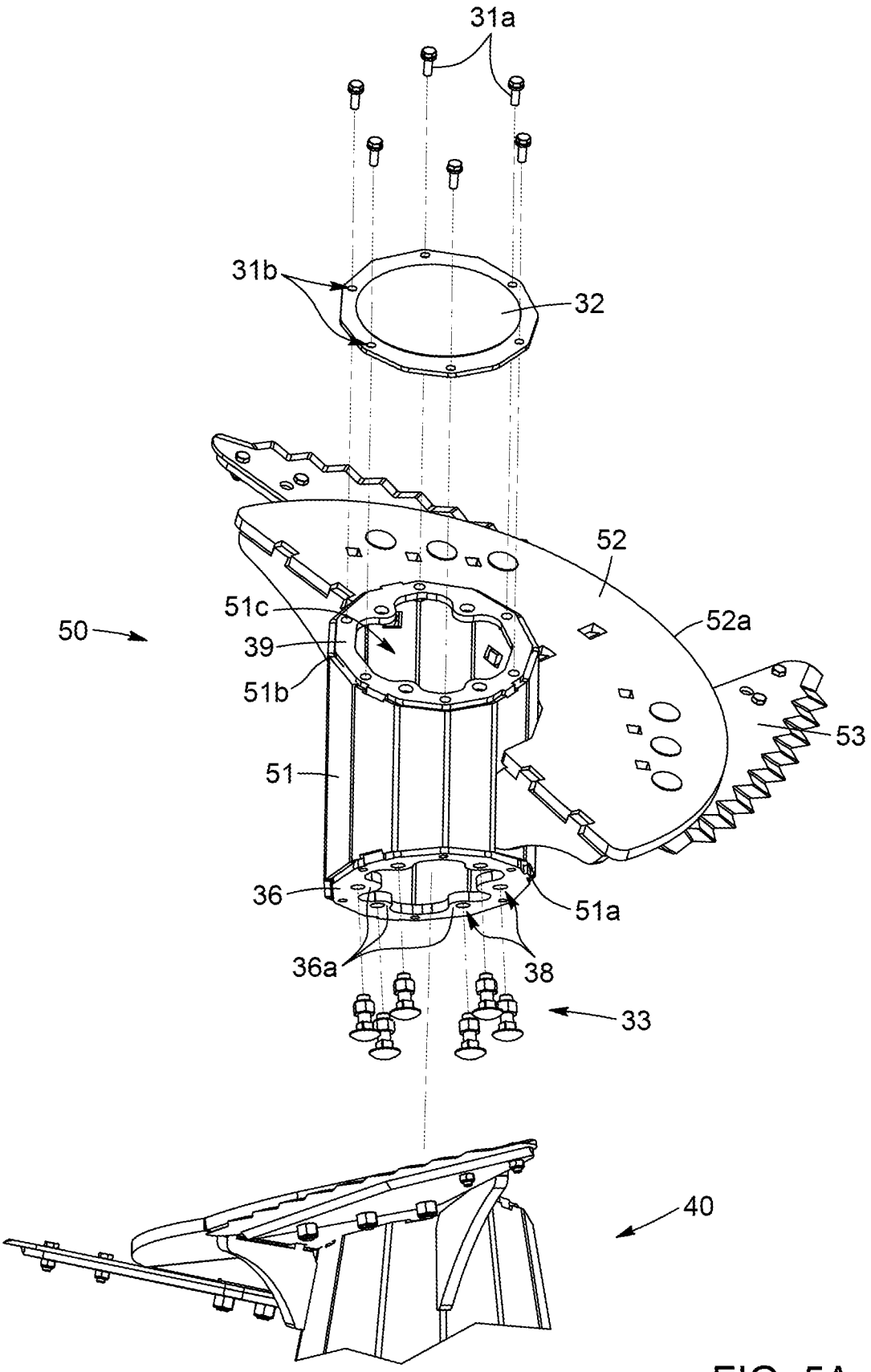
FIG. 5A is a rear exploded view of an upper section of the extendable auger of FIG. 5.
Figure 6:
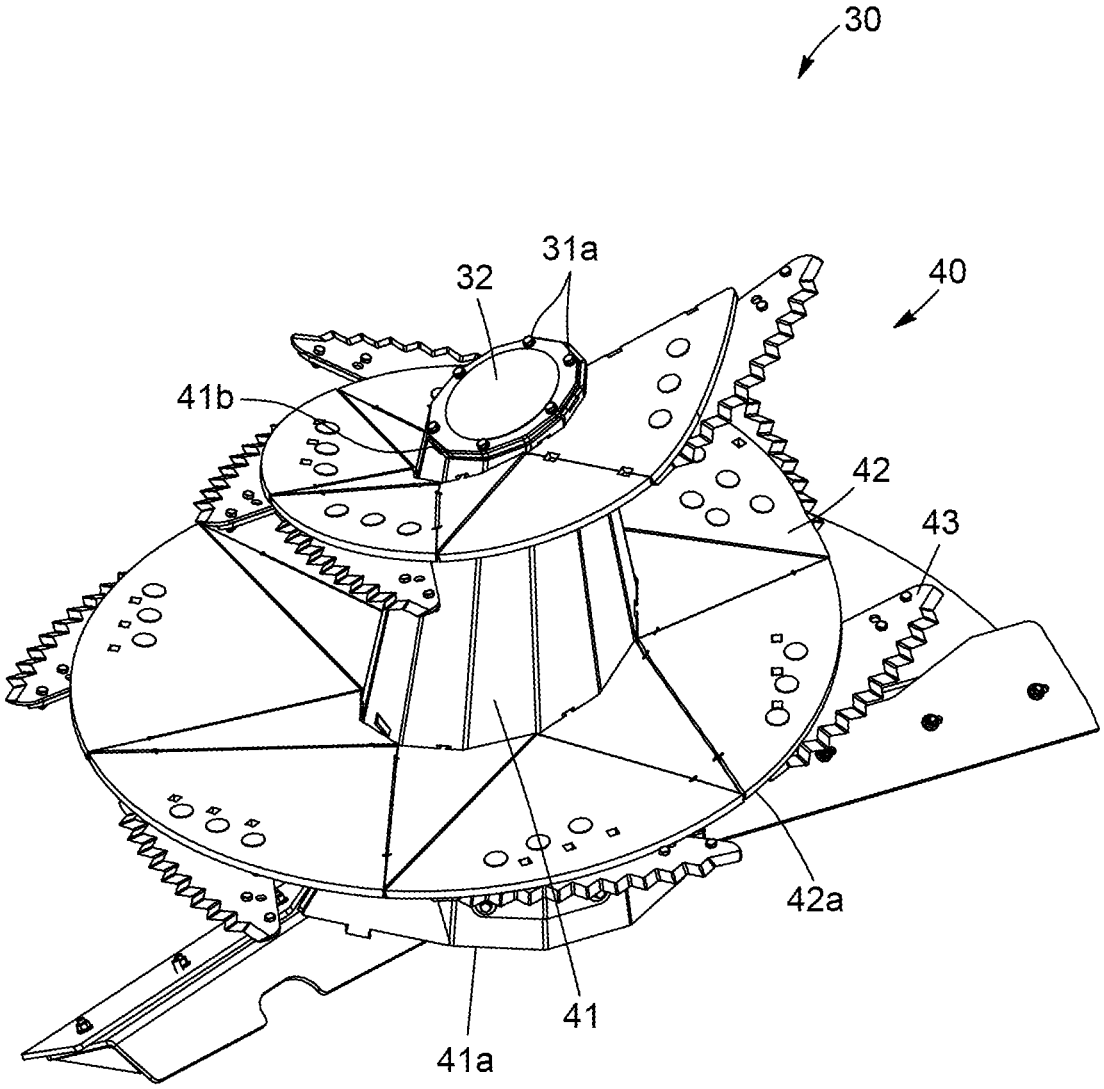
FIG. 6 is an isometric view of the extendable auger of FIG. 5, shown in the base configuration.
Figure 7:
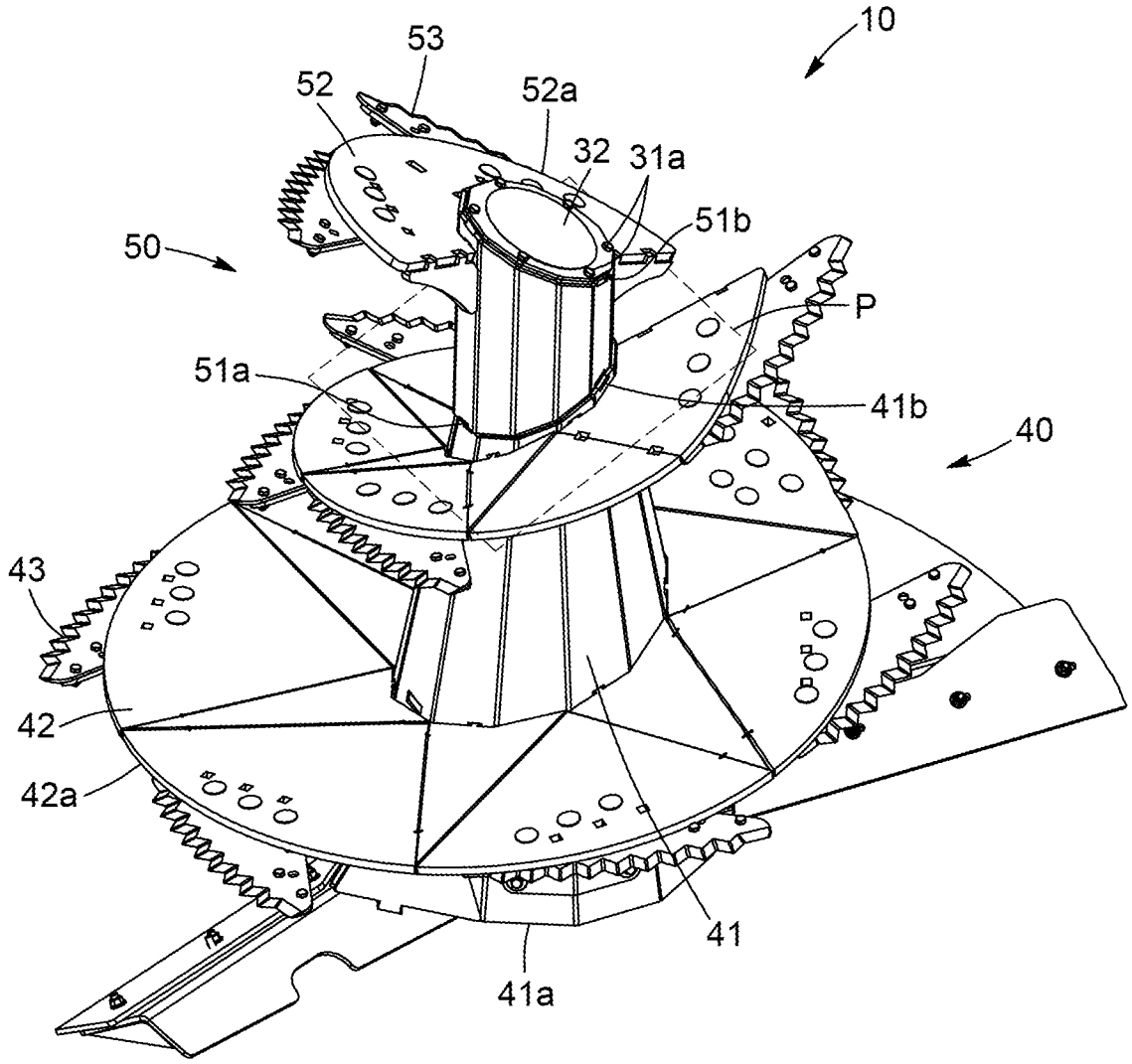
FIG. 7 is an isometric view of the extendable auger of FIG. 5, shown in the extended configuration.

In an embodiment, the vertical mixer 10 further includes a tub wall extension 18 removably mountable to the tub wall 14, at a top edge 14*c* thereof. FIGS. 3 and 4 show the vertical mixer 10 with the tub wall extension 18 mounted at the top edge 14*c* of the tub wall 14, while FIGS. 1 and 2 show the vertical mixer 10 without the tub wall extension 18 secured to the tub wall 14, at the top edge 14*c* thereof. One skilled in the art will understand that, several known securements means and/or methods could be used to mount the tub wall extension 18 to the tub wall 14. For example and without being limitative, in an embodiment the tub wall extension 18 can be secured to the tub wall 14 using a combination of nuts and bolts insertable into fixation bores, but one skilled in the art will understand that, in alternative embodiments (not shown), other types of fasteners could be used to secure the tub wall extension 18 to the tub wall 14. In other alternative embodiments (not shown), the tub wall extension 18 could be permanently mounted to the tub wall 14, at a top edge 14*c* thereof.

When mounted to the tub wall 14, the tub wall extension 18 provides a continuity of the tub wall 14, with the tub wall extension 18 extending continuously substantially vertically, upwardly from the tub wall 14, in order to increase the capacity of the mixing chamber 16 defined by the combination of the tub wall and the tub wall extension 18. In an embodiment, the tub wall extension 18 has a height of between about 6 inches and about 24 inches. In other words, in such an embodiment, the tub wall extension 18 increases the height of the tub wall 14 of between about 6 inches and about 24 inches, when mounted to the tub wall 14.

In an embodiment, the tub wall extension 18 includes a plurality of tub wall sections 19, each mounted at the top edge 14*c* of a corresponding section of the tub wall 14, and laterally adjacent to one another, to define a continuous wall section extending continuously upwardly from the tub wall 14. The laterally adjacent tub wall sections 19 can be connected to one another, once again using known securements means and/or methods, such as nuts and bolts, or the like. One skilled in the art will understand that, in an alternative embodiment (not shown), the tub wall extension 18 could also be a single piece structure securable to the tub wall 14, at a top edge 14*c* thereof.

Referring to FIGS. 1 to 7, the vertical mixer 10 also includes at least one extendable auger 30, extending substantially vertically into the mixing chamber 16, from the bottom thereof, and rotatable to mix the feedstuffs received in the mixing chamber 16. As will be described in more details below, each one of the extendable augers 30 includes a base section 40 removably engageable to an extension section 50 securable to the base section 40 and extending upwardly and substantially vertically therefrom, when mounted thereto. In view of the above, the at least one extendable auger 30 is configurable between a base configuration (see FIGS. 1, 2 and 6) where the extendable auger 30 is free of extension section 50 and includes only the base section 40, and an extended configuration (see FIGS. 3, 4 and 7) where the extendable auger 30 includes the base section 40 and the extension section 50 mounted on top of the base section 40 and extending upwardly therefrom.

In an embodiment, the extension section 50 has a height of between about 8 inches and about 24 inches. In other words, in such an embodiment, the extension section 50 increases the height of the extendable auger 30 of between about 8 inches and about 24 inches when mounted to the base section 40. In an embodiment, the extension section 50 increases the height of the extendable auger 30 of between about 20% and about 50%, when mounted to the base section.

In the embodiment shown, three extendable augers 30 are provided, but one skilled in the art will understand that, in alternative embodiments (not shown), the vertical mixer 10 could include a single extendable auger 30, two extendable augers 30, or more than the three extendable augers 30 of the embodiment shown. One skilled in the art will understand that the number of extendable augers 30 of a vertical mixer 10 typically matches the size of the mixing chamber 16 of the vertical mixer 10, with vertical mixers 10 having a larger mixing chamber 16 including more extendable augers 30 than vertical mixers 10 having a smaller mixing chamber 16. In order to ease the description, reference to a single extendable auger will be made in the description below, each one of the extendable augers 30 having the same characteristics and operation.

In the embodiment shown, the base section 40 of the extendable auger 30 includes a base section central shaft 41 having a hollow core 41*c* and extending substantially vertically. The base section central shaft 41 has a bottom end 41*a* and a top end 41*b*. The base section 40 of the extendable auger 30 also includes a base section helical member 42 mounted to the base section central shaft 41 and extending peripherally therefrom. In the embodiment shown, the base section helical member 42 has an outer helical edge 42*a* with base section serrated cutting blades 43 mounted to the base section helical member 42 and extending past the outer helical edge 42*a* thereof. In other words, the base section serrated cutting blades 43 are mounted to the base section helical member 42 and are positioned to project from the helical edge 42*a* of the base section helical member 42, to favor the cutting of the strands of forages, upon rotation of the extendable auger 30 in a selected rotation direction.

It will however be understood that, in alternative embodiments (not shown), the base section 40 of the extendable auger 30 could be free of base section serrated cutting blades 43. In such embodiments (not shown), the base section 40 of the extendable auger 30 includes only the base section central shaft 41 and the base section helical member 42 mounted thereto. The base section serrated cutting blades 43 can be provided inside the mixing chamber 16, rather than mounted to the base section helical member 42 of the extendable auger 30. For example and without being limitative, in an embodiment (not shown), stationary serrated cutting blades (not shown) can be mounted to the inner surface 14*a* of the tub wall 14. In another alternative embodiment, stationary serrated cutting blades (not shown) mounted to the inner surface 14*a* of the tub wall 14 can be provided in addition to the base section serrated cutting blades 43 of the base section 40 of the extendable auger 30, to increase the cutting action performed in the feedstuff, when the material inside the mixing chamber 16 is processed by the rotation of the extendable auger 30.

Similarly to the base section 40, the extension section 50 of the extendable auger 30 includes an extension section central shaft 51 having a hollow core 51*c* and extending substantially vertically. The extension section central shaft 51 has a bottom end 51*a* and a top end 51*b*. The extension section 50 also includes an extension section helical member 52 mounted to the extension section central shaft 51 and extending peripherally therefrom. Once again, in the embodiment shown, the extension section helical member 52 has an outer helical edge 52*a* with serrated extension section cutting blades 53 mounted to the extension section helical member 52 and positioned to project from the helical edge 52*a* of the extension section helical member 52, to favor the cutting of the strands of forages, upon rotation of the extension section 50 of the extendable auger 30 in the selected rotation direction.

When the extension section 50 is secured on top of the base section 40, the base section helical member 42 and the extension section helical member 52 extend substantially continuously along the consecutive base section central shaft 41 and extension section central shaft 51. In other words, the extension section helical member 52 and the base section helical member 42 are positioned and configured to act together as a single continuous helical member.

Once again, in alternative embodiments (not shown), the extension section 50 of the extendable auger 30 could be free of base section serrated cutting blades 43, with the extension section 50 of the auger 30 including only the extension section central shaft 51 and the extension section helical member 52 mounted thereto.

In order to allow the mounting of the extension section 50 to the base section 40 (with the extension section 50 being on top of the base section 40), the extendable auger 30 further includes an extension fixation assembly 34 configured to securely and removably secure (or fasten) the extension section 50 of the extendable auger 30 to the base section 40 thereof. In the embodiment shown, the extension fixation assembly 34 includes a base support wall 35 positioned at the top end 41*b* of the base section central shaft 41 of the base section 40 and an extension abutment wall 36 positioned at the bottom end 51*a* of the extension section central shaft 51 of the extension section 50. The base support wall 35 and the extension abutment wall 36 are engageable to one another (i.e. are abuttable against one another) and securable thereagainst, to mount the extension section 50 to the base section 40. In other words, the base support wall 35 and the extension abutment wall 36 extend along a common engagement plane P, such that the extension abutment wall 36 can be superposed to the base support wall 35, with the extension section 50 being fastened to the base section 40.

In an embodiment, each one of the base support wall 35 and the extension abutment wall 36 extend at an angle relative to the horizontal plane. In an embodiment, the angle of each one of the base support wall 35 and the extension abutment wall 36 relative to the horizontal plane ranges between about 1 degree and about 60 degrees. One skilled in the art will understand that, in an alternative embodiment (not shown), each one of the base support wall 35 and the extension abutment wall 36 could also extend substantially parallel to the horizontal plane.

One skilled in the art will understand that the base support wall 35 and/or the extension abutment wall 36 can be mounted to the corresponding one of the base section central shaft 41 and the extension section central shaft 51, for example and without being limitative by welding, brazing, soldering, riveting or the like. In an alternative embodiment, the base support wall 35 and/or the extension abutment wall 36 can be integral to the corresponding one of the base section central shaft 41 and the extension section central shaft 51.

In an embodiment, an extension support wall 39 is also provided at the top end 51*b* of the extension section central shaft 51 of the extension section 50. Hence, in an embodiment (not shown), a second auger extension (not shown) could be mounted on top of a first auger extension (not shown), similar to the extension section 50 of the embodiment shown. One skilled in the art will understand that, in such an embodiment (not shown), the second auger extension (not shown) could be secured to the first auger extension (not shown), similarly to the extension section 50 being secured to the base section 40 of the embodiment shown.

The extension fixation assembly 34 further includes a fastening assembly 37 configured to removably secure the extension section 50 to the base section 40, when the base support wall 35 and the extension abutment wall 36 are engaged (or superposed) to one another. In the embodiment shown, the fastening assembly 37 includes fastening bores 38 (or channel) defined in the base support wall 35 and the extension abutment wall 36 and configured to receive auger extension fasteners 33 therein, to securely maintain the base support wall 35 and the extension abutment wall 36 engaged to one another.

In the embodiment shown, the fastening assembly 37 includes substantially squared shape fastening bores 38 defined in the base support wall 35 and substantially rounded shape fastening bores 38 defined in the extension abutment wall 36, with the auger extension fasteners 33 being embodied by carriage bolts, each insertable in corresponding fastening bores 38 of the base support wall 35 and the extension abutment wall 36 successively, from below (with the head of the carriage bolts engaging the bottom surface of the base support wall 35 and a squared section of the carriage bolts inserted in the squared shape fastening bores 38 of the base support wall 35). Nuts can subsequently be threaded in the carriage bolts to fasten the auger extension fasteners 33 and securely maintain the base support wall 35 and the extension abutment wall 36 engaged to one another.

One skilled in the art will understand that, in alternative embodiments (not shown), the fastening assembly 37 could differ from the one of the embodiment shown. For example and without being limitative, in an embodiment, the auger extension fasteners 33 can be threaded fasteners (i.e. fasteners having external threads, such as bolts), with the fastening bores 38 defined in one of the base support wall 35 and the extension abutment wall 36 having internal threads matching the threads of the auger extension fasteners 33 defined in a peripheral wall thereof. In such an embodiment, the auger extension fasteners 33 can be inserted in the unthreaded fastening bores 38 of the base support wall 35 or the extension abutment wall 36 and be threaded in the threads defined in the peripheral walls of the fastening bores 38 of the other one of the base support wall 35 or the extension abutment wall 36. One skilled in the art will understand that, in an alternative embodiment (not shown), the fastening bores 38 of the base support wall 35 or the extension abutment wall 36 could also both have internal threads defined in a peripheral wall thereof.

One skilled in the art will understand that, in alternative embodiments (not shown), a fastening assembly 37 different from the assembly of the embodiment shown and allowing the extension section 50 to be removably secured to the base section 40, could also be used. For example and without being limitative, in an embodiment, the base support wall 35 and the extension abutment wall 36 could include complementary male/female members, for example allowing the extension section 50 to slidingly engage to the base section 40, or the like.

In the embodiment shown, the base support wall 35 and the extension abutment wall 36 are annular walls (i.e. the base support wall 35 and the extension abutment wall 36 each extend along a periphery of the corresponding base section central shaft 41, 51 and include a hollow central section), thereby permitting access to the hollow core 41*c*, 51*c* of the base section central shaft 41, 51 of the corresponding one of the base section 40 and the extension section 50, in order to secure the extension section 50 to the base section 40.

In the embodiment shown, the base support wall 35 and the extension abutment wall 36 also each include projections 35*a*, 36*a* extending inwardly towards the hollow central section thereof, with the fastening bores 38 each being defined in a section of a corresponding one of the projections 35*a*, 36*a*. One skilled in the art will understand that, in an alternative embodiment (not shown), the projections 35*a*, 36*a* could project outwardly of the base support wall 35 and the extension abutment wall 36 (i.e. in a direction substantially opposite to the hollow central section thereof).

In order to close the hollow core 41*c*, 51*c* of the base section central shaft 41, 51 of the corresponding one of the base section 40 and the extension section 50 (i.e. in order to prevent silage or the like to enter the hollow core 41*c*, 51*c* of the base section central shaft 41, 51), the extendable auger 30 further includes a cover 32 (or cap) mounted to the base section central shaft 41, 51 of the corresponding one of the base section 40 and the extension section 50, at a top end 41*b*, 51*b* thereof.

When no extension section 50 is mounted onto the base section 40, the cover 32 is superposed and mounted to the base section central shaft 41 of the base section 40 and covers the top end 41*b* thereof (i.e. covers the base support wall 35). In other words, when the cover 32 is mounted to the base section central shaft 41 of the base section 40, it is superposed to the base support wall 35, and prevents access thereto (and consequently prevents access to the fastening bores 38 of the fastening assembly 37 defined in the base support wall 35). In an embodiment, the cover 32 is removably securable to the base support wall 35, for example through engagement of cover fasteners 31*a* (such as, for example and without being limitative, threaded bolts) in dedicated corresponding cover fastening bores 31*b* (such as, for example and without being limitative, threaded bores) defined in the support walls 35.

Similarly, when the extension section 50 is mounted onto the base section 40, the cover 32 is superposed and mounted to the extension section central shaft 51 of the extension section 50 and covers the top end 51*b* thereof (i.e. covers the extension support wall 39). In an embodiment, the cover 32 is removably securable to the extension support wall 39, for example through engagement of cover fasteners 31*a* (such as, for example and without being limitative, threaded bolts) in dedicated corresponding cover fastening bores 31*b* (such as, for example and without being limitative, threaded bores) defined in the extension support wall 39.

Hence, to mount an extension section 50 to the base section 40 of the extendable auger 30, the cover 32 must be removed (for example by unfastening the cover fasteners 31*a* from the cover fastening bores 31*b* of the base support wall 35), thereby exposing the base support wall 35. Subsequently, the extension section 50 can be engaged with the base section 40 of the extendable auger 30, through the extension section 50 being positioned on top of the base section 40, with the base support wall 35 and the extension abutment wall 36 being engaged to one another. In an embodiment, the fastening bores 38 defined in the base support wall 35 and the extension abutment wall 36 are aligned (or placed in register) to allow insertion of the auger extension fasteners 33 therein and the extension section 50 is secured to the base section 40 using the auger extension fasteners 33. Finally, the cover 32 is superposed and mounted to the extension section central shaft 51 of the extension section 50 and is secured to the extension support wall 39, for example through engagement of cover fasteners 31*a* (such as, for example and without being limitative, threaded bolts) in dedicated corresponding cover fastening bores 31*b* (such as, for example and without being limitative, threaded bores) defined in the extension support wall 39.

For example and without being limitative, in the embodiment shown, securing of the extension section 50 to the base section 40 can be performed by an operator by inserting an arm in the exposed hollow core of the central shaft 51*c* of the extension section 50 and hollow core of the central shaft 41*c* of the base section 40 and by inserting an auger extension fastener 33 (such as a carriage bolt) in each corresponding fastening bore 38 defined in the base support wall 35 and the extension abutment wall 36, from below. The auger extension fastener 33 can subsequently be temporarily held in place by the user to prevent falling thereof by gravity, while they are fastened (for example by threading a nut onto the carriage bolt), using the other arm of the user, to securely maintain the base support wall 35 and the extension abutment wall 36 engaged to one another. One skilled in the art will understand that, in alternative embodiment (not shown), where different fastening assemblies could be used, different steps could also be performed to secure the extension section 50 to the base section 40.

In an embodiment, not shown, the vertical mixer 10 can be mounted onto a trailer chassis for supporting the vertical mixer 10. In an embodiment, the trailer chassis is couplable to a motorized vehicle, such as, for example and without being limitative, a tractor (not shown), to allow displacement of the vertical mixer 10. One skilled in the art will understand that the vertical mixer 10 can also be free of trailer chassis and be substantially stationary, rather than easily displaceable.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention could be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. An extendable auger for a vertical mixer, the extendable auger comprising:

a base section including a base section central shaft having a hollow core and a top end, the base section further including a base section helical member having a helical edge and being mounted to the base section central shaft to extend peripherally therefrom;

an extension section removably securable to the base section, with the extension section positioned over the base section, the extension section including an extension section central shaft having a hollow core, a lower end and a top end with an extension support wall positioned at the top end thereof, the extension section further including an extension section helical member having a helical edge and being mounted to the extension section central shaft to extend peripherally therefrom;

an extension fixation assembly including a base support wall positioned at the top end of the base section central shaft and an extension abutment wall positioned at the bottom end of the extension section central shaft, the base support wall being superposable to the extension abutment wall and securable thereagainst, the extension fixation assembly further including a fastening assembly configured to removably secure the extension section to the base section, when the base support wall and the extension abutment wall are superposed to one another; and a cover superposable and removably securable to one of the base support wall and the extension support wall wherein the base support wall and the extension abutment wall are angled relative to a horizontal plane between about 1 degree and about 60 degrees.

2. The extendable auger of claim 1, wherein the base section further comprises base section serrated cutting blades mounted to the base section helical member and extending past the helical edge thereof and wherein the extension section further comprises extension section serrated cutting blades mounted to the extension section helical member and extending past the helical edge thereof.

3. The extendable auger of claim 1, wherein the fastening assembly includes fastening bores defined in the base support wall and the extension abutment wall, the fastening bores being aligned when the base support wall and the extension abutment wall are superposed to one another, to receive auger extension fasteners therein.

4. The extendable auger of claim 3, wherein each one of the base support wall and the extension abutment wall are annular walls including a hollow central section providing access to the hollow core of the corresponding one of the base section central shaft and the extension section central shaft.

5. The extendable auger of claim 4, wherein each one of the base support wall and the extension abutment wall include projections projecting inwardly towards the hollow central section thereof, with the fastening bores each being defined in a section of a corresponding one of the projections.

6. The extendable auger of claim 1, wherein the extension section increases a height of the extendable auger of between about 20% and about 50%, when mounted to the base section.

7. A vertical mixer comprising:

a tub including a tub wall having a top edge and an inner surface defining a mixing chamber having an open top and a closed bottom, the tub further including a tub wall extension mountable to the tub wall, at a top edge thereof; and at least one extendable auger extending substantially vertically into the mixing chamber, from the bottom thereof, each one of the at least one extendable auger comprising:

a base section including a base section central shaft having a hollow core and a top end, the base section further including a base section helical member having a helical edge and being mounted to the base section central shaft to extend peripherally therefrom;

an extension section removably securable to the base section, with the extension section positioned over the base section, the extension section including an extension section central shaft having a hollow core, a lower end and a top end with an extension support wall positioned at the top end thereof, the extension section further including an extension section helical member having a helical edge and being mounted to the extension section central shaft to extend peripherally therefrom;

an extension fixation assembly including a base support wall positioned at the top end of the base section central shaft and an extension abutment wall positioned at the bottom end of the extension section central shaft, the base support wall being superposable to the extension abutment wall and securable thereagainst, the extension fixation assembly further including a fastening assembly configured to removably secure the extension section to the base section, when the base support wall and the extension abutment wall are superposed to one another; and a cover superposable and removably securable to one of the base support wall and the extension support wall wherein the base support wall and the extension abutment wall are angled relative to a horizontal plane between about 1 degree and about 60 degrees.

8. The vertical mixer of claim 7, wherein the base section of the extendable auger further comprises base section serrated cutting blades mounted to the base section helical member and extending past the helical edge thereof and wherein the extension section of the extendable auger further comprises extension section serrated cutting blades mounted to the extension section helical member and extending past the helical edge thereof.

9. The vertical mixer of claim 7, wherein the fastening assembly includes fastening bores defined in the base support wall and the extension abutment wall, the fastening bores being aligned when the base support wall and the extension abutment wall are superposed to one another, to receive auger extension fasteners therein.

10. The vertical mixer of claim 9, wherein each one of the base support wall and the extension abutment wall are annular walls including a hollow central section providing access to the hollow core of the corresponding one of the base section central shaft and the extension section central shaft.

11. The vertical mixer of claim 10, wherein each one of the base support wall and the extension abutment wall include projections projecting inwardly towards the hollow central section thereof, with the fastening bores each being defined in a section of a corresponding one of the projections.

12. The vertical mixer of claim 7, wherein the extension section increases a height of the extendable auger of between about 20% and about 50%, when mounted to the base section.

13. An auger extension for an auger of a vertical mixer including an extendable auger having a base section with a base support wall positioned at a top edge thereof, the auger extension comprising:

an extension section removably securable on top of the base section, the extension section including an extension section central shaft having a hollow core, a lower end and a top end with an extension support wall positioned at the top end thereof, the extension section further including an extension section helical member having a helical edge and being mounted to the extension section central shaft to extend peripherally therefrom;

an extension fixation assembly including an extension abutment wall positioned at the bottom end of the extension section central shaft, the extension abutment wall being superposable to the base support wall and securable thereagainst, the extension fixation assembly further including a fastening assembly configured to removably secure the extension section to the base section, when the base support wall and the extension abutment wall are superposed to one another; and a cover superposable and removably securable to the extension support wall wherein the base support wall and the extension abutment wall are angled relative to a horizontal plane between about 1 degree and about 60 degrees.

14. The auger extension of claim 13, wherein the extension section further comprises extension section serrated cutting blades mounted to the extension section helical member and extending past the helical edge thereof.

15. The auger extension of claim 13, wherein the fastening assembly includes fastening bores defined in the extension abutment wall, the fastening bores being aligned with corresponding bores defined in the base support wall when the base support wall and the extension abutment wall are superposed to one another, to receive auger extension fasteners therein.

16. The auger extension of claim 13, wherein the extension abutment wall is an annular wall including a hollow central section providing access to the hollow core of the extension section central shaft.

17. The auger extension of claim 15, wherein the extension abutment wall includes projections projecting inwardly towards the hollow central section thereof, with the fastening bores each being defined in a section of a corresponding one of the projections.

18. The auger extension of claim 13, wherein the extension section increases a height of the extendable auger of between about 20% and about 50%, when mounted to the base section.

* * * * *